United States Patent [19]

Grigsby

[11] 4,321,837

[45] Mar. 30, 1982

[54] AUXILIARY COUNTER BALANCE FOR WELL PUMP

[76] Inventor: Roy E. Grigsby, 5433 Durham Ave., Forth Worth, Tex. 76114

[21] Appl. No.: 182,118

[22] Filed: Aug. 28, 1980

Related U.S. Application Data

[63] Continuation-in-part of Ser. No. 73,694, Sep. 10, 1979, abandoned, which is a continuation-in-part of Ser. No. 918,675, Jun. 23, 1978, abandoned.

[51] Int. Cl.[3] ..... F16H 21/32; G05G 1/00

[52] U.S. Cl. ..... 74/41; 74/591

[58] Field of Search ..... 74/41, 52, 591, 603

[56] References Cited

U.S. PATENT DOCUMENTS

| | | | |
|---|---|---|---|
| 1,712,927 | 5/1929 | Martois | 74/52 |
| 1,948,288 | 2/1934 | Corey | 74/41 |
| 3,222,940 | 12/1965 | Chastain | 74/41 |
| 3,364,755 | 1/1968 | Miller | 74/41 |
| 3,805,627 | 4/1974 | Burton et al. | 74/52 |
| 3,830,212 | 8/1974 | Seino et al. | 74/603 |
| 4,095,579 | 6/1978 | Iwasa et al. | 74/603 |

*Primary Examiner*—Lawrence J. Staab
*Attorney, Agent, or Firm*—Arthur F. Zobal

[57] ABSTRACT

A well pump having a walking beam operated by a pitman and crank, the latter of which has a main counter weight connected to its end for counter balancing the weight of the rod string and one-half of the weight of the fluid pumped. An auxiliary counter weight is coupled to the crank between its driving shaft and the main counter weight and is rotated relative to the crank to aid in counter balancing the remaining portion of the fluid pumped.

9 Claims, 6 Drawing Figures

AUXILIARY COUNTER BALANCE FOR WELL PUMP

This application is a continuation-in-part of U.S. Patent Application Ser. No. 73,694 filed Sept. 10, 1979, now abandoned, which is a continuation-in-part of U.S. Patent Application Ser. No. 918,675 filed June 23, 1978, now abandoned.

FIELD OF THE INVENTION

This invention relates to a well pump of the walking beam type.

DESCRIPTION OF THE PRIOR ART

In well pumps of the walking beam type, auxiliary counter weights have been proposed to counter balance the weight of the fluid being pumped. Apparently, these auxiliary counter weights have not been effective since I do not know of any well pump that use such auxiliary counter weights.

SUMMARY OF THE INVENTION

It is an object of the present invention to provide a new and useful auxiliary counter weight in a well pump of the walking beam type.

In accordance with the present invention, the auxiliary counter weight is coupled to the well crank between its shaft and its main counter weight. In operation, the auxiliary counter weight is rotated relative to the crank to aid counter balancing the fluid being pumped.

DESCRIPTION OF THE PREFERRED EMBODIMENTS

Figure 1:
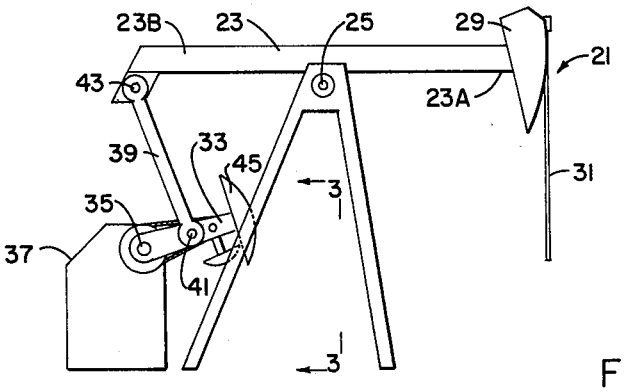
FIG. 1 illustrates a walking beam pump incorporating the present invention.
Figure 3:
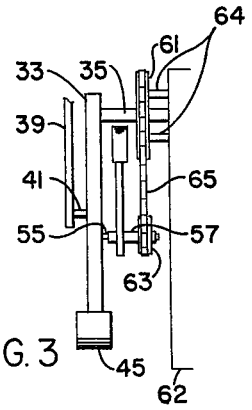
FIG. 3 is a partial view of FIG. 1 taken along the lines 3—3 with the crank in a different position from that shown in FIG. 1.
Figure 2:
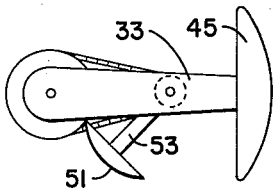
FIG. 2 is an enlarged view of the crank of the pump of FIG. 1 showing the present invention in more detail.

Referring now to the drawings, reference numeral 21 designates a well pumping unit of the walking beam type for pumping oil from a borehole (not shown) which extends down to an oil bearing formation. The pumping unit comprises a walking beam 23 pivotally supported by means 27 to a Sampson post 27. A horse head 29 is connected to one end 23A of the beam 23. A polished rod 31 which forms the uppermost rod of a sucker rod string is connected to the horse head 29. The sucker rod string extends dow into the borehole to a downhole pump. A crank 33 is fixedly connected to a shaft 35 which is rotated by a prime mover 37. Thus, rotation of the shaft 35 causes rotation of the crank 33. A pitman 39 has one end pivotally coupled to the crank 33 by a pin 41 and an opposite end pivotally coupled to the beam end 23A by a pin 43. Although not shown, a second crank identical with crank 33 is fixedly connected to the shaft 35 on the other side of the prime mover 37 and has a pitman pivotally connected thereto which also is pivotally connected to the beam end 23B. Both cranks 33 are in phase with each other. Upon rotation of the cranks 33, the pitmans will cause the beam 23 to rock up and down about its axis 25 to pump fluid to the surface.

The outer ends of the cranks 33 have counter weights 45 connected thereto for counter balancing the weight of the sucker rod string and one-half of the weight of the fluid column raised by the rod string. The counter weights 45 may be adjusted to different radial positions on the cranks 33 depending on the depth of the well.

Heretofore, expensive reducers have been required in such pumping units since the full weight of the fluid column is not counter balanced.

Figure 4:
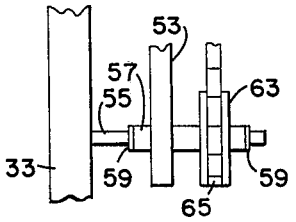
FIG. 4 is an enlarged view of a portion of FIG. 3.

In accordance with the present invention, there is provided an auxiliary counter weight rotatably coupled to each of the cranks 33 for counter balancing the other half of the weight of the fluid column being pumped. This has advantages since it eliminates the need of a reducer which conventionally is employed to handle the weight of the other half of the fluid column being pumped and which is very expensive. The two auxiliary counter weights are identical and are driven in phase or out of phase with each other. Only one auxiliary counter weight will be described. In the drawings, reference numeral 51 designates one of the auxiliary counter weights. It is connected to a rod 53 which is rotatably connected to the crank 33 at a position between the point of connection of shaft 35 with the crank 33 and the main counter weight 45. One manner in which the rod 53 is rotatably connected to the crank 33 is shown in FIG. 4. In this embodiment, a rod 55 is fixedly connected to the crank 33. A sleeve 57 is fitted around the rod 55. Stops 59 connected to the rod 55 prevent axial movement of the sleeve 57. Bearings, not shown, are provided between the sleeve 57 and rod 55 to allow the sleeve 57 to rotate around the rod 55. The auxiliary counter weight rod 53 is fixedly connected to the sleeve 57 whereby the auxiliary counter weight 51 may rotate about the rod 55 relative to the crank.

Means for rotating each of the auxiliary counter weights 51 is provided in order to properly counter balance the remaining one-half of the weight of the fluid column being pumped. This means comprises a sprocket 61 fixedly connected to housing 62 of the prime mover 37 by way of rods 64, a sprocket 63 fixedly connected to sleeve 57 and a continuous chain 65 extending around sprocket 61 and 63. The shaft 35 extends freely through a central aperture (not shown) formed through sprocket 61 and is rotatable by the prime mover 37 relative to the sprocket 61 which is fixed in place against movement. Thus, as shaft 35 and hence the crank 33 are rotated by the prime mover 37, chain 65 rotates sprocket 63 and hence the sleeve 57 and auxiliary counter weight 51. As mentioned above, an identical auxiliary counter weight 51 is rotatably connected to the second crank 33 on the other side of the prime mover 37 between its shaft and main counter weight. It is driven in the same manner by sprockets and a chain identical to sprockets 61 and 63 and chain 65. The size of the sprockets 61 and 63 are selected and the positions of the auxiliary counter weights 51 adjusted relative to the cranks 53 such that the auxiliary counter weights 51 will counter balance the weight of one-half of the fluid column not counter balanced by the main counter weights 45. In addition, the two auxiliary counter weights 51 may be adjusted to be in phase with each other or out of phase with each other in order to achieve the desired counter balance.

Figure 5:
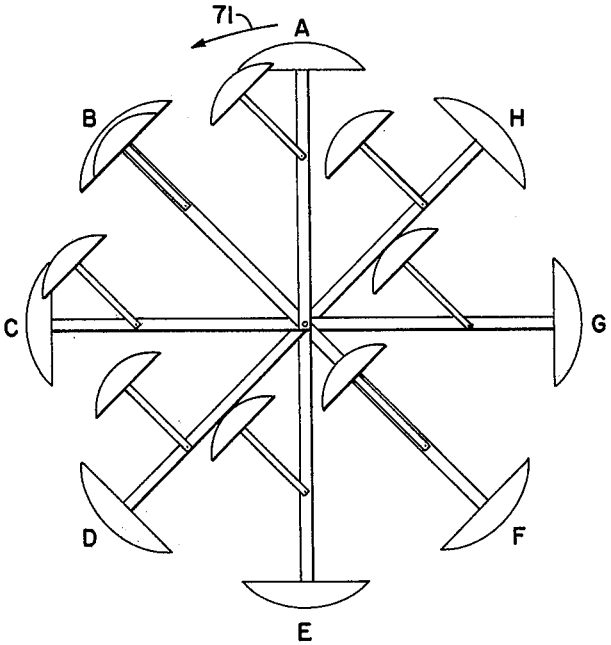
FIG. 5 shows the sequential positions of the auxiliary counter weight relative to the crank during a complete cycle of rotation of the crank.

Referring to FIG. 5, there is shown eight positions (A-H) of one of the main counter weights and its auxiliary counter weight during a complete cycle of the walking beam 23 beginning at the start of the up stroke. Rotation of the main counter weight 45 is counter clockwise as shown by the arrow 71. The auxiliary counter weight 51 rotates relative to the main counter weight 45 as shown in FIG. 5. At position A, the walking beam 23 is at its minimum down position and is at the start of its up stroke. At position E, the walking beam 23 is at its maximum up position and is at the start of its down stroke. Each of the auxiliary counter weights achieves its maximum counter balancing effectiveness when it is at its radially outer most position. For the auxiliary counter weight shown, maximum auxiliary counter balancing is achieved at position B of the cycle. The other auxiliary counter weight may be in phase with the auxiliary counter weight shown. It may also be adjusted to be out of phase with the auxiliary counter weight shown such that it achieves its maximum counter balancing effectiveness at a different position of the cycle such as at cycle position C. This allows the counter balancing of the auxiliary counter weights to be carried out during an increased portion of a complete cycle of the walking beam. Thus, the positions of the auxiliary counter weights 51 relative to that of the main counter weights 45 and relative to each other may be adjusted to achieve the desired auxiliary counter balancing depending upon the depth of the well. Each of the auxiliary counter weights also may be adjusted to different radial positions on its support rod 53.

Although sprockets and a chain are disclosed for rotating each of the auxiliary counter weights, it is to be understood that other means may be provided such as pulleys and a belt, electric motors, air and hydraulic motors and caming actions.

It is to be further understood that each of the cranks 33 may be formed as a heavy weight member thereby incorporating therein the main counter weight and eliminating the particular form of the main counter weight 45 shown. In this embodiment the member 33 would serve both as a crank and main counter weight. The shaft 53 of the auxiliary counter weight would be rotatably coupled to member 33 in the same manner as shown in the drawings as described in the specification.

Figure 6:
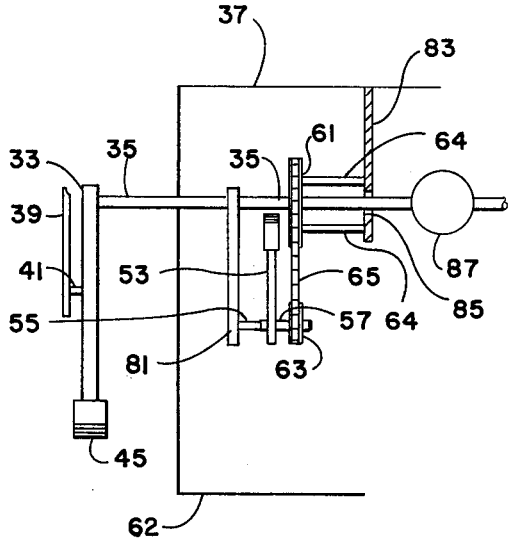
FIG. 6 is another embodiment of the present invention.

Referring to FIG. 6, there is disclosed another embodiment having an arm 81 fixedly connected to the shaft 35 at an angle 90° relative to its axis for rotation therewith. The arm 81 preferably is in alignment with the crank 33 and rotates with the crank 33. The rod 55 is connected to the arm 81 rather than to the crank 33. Rod 55 is connected to the arm 81 at the desired radial position between the shaft 35 and the counter weight 45. The sleeve 57 is rotatably located around the rod 55 with the rod 53 of the auxiliary counter weight 51 and sprocket 63 fixedly connected to the sleeve 57 as disclosed previously. Sprocket 61 is fixedly secured in place by rods 64 which are connected to a plate 83 which in turn is connected to the housing 62. The shaft 35 extends freely through aperture 85 formed through plate 83 and through the central aperture of sprocket 61 and is rotated by motor 87 of the prime mover 37. The chain 63 extends around sprockets 61 and 63 and the system operates as disclosed previously. In this embodiment, the auxiliary counter weight 51 thus is coupled to crank 33 by way of the arm 81 and shaft 35. In FIG. 6, the bearings for shaft 35 are not shown for purposes of clarity.

What is claimed is:

1. A well pumping unit comprising:

a walking beam pivotally coupled to a Sampson post for pumping operations, sucker rod means coupled to one end of said walking beam, crank means, power means having shaft means connected to said crank means at a first end for rotating said crank means, main counter weight means fixedly connected to said crank means at an end opposite said first end for counter balancing the weight of said sucker rod means and a portion of the weight of the fluid pumped, pitman means pivotally connected to said crank means and to said walking beam at an end opposite said one end for operating said walking beam upon rotation of said crank means, an axle fixedly connected to said crank means at a position between said main counter weight means and the point of the connection of said shaft means to said crank means, said axle rotating with said crank means as said crank means is rotated by said power means, auxiliary counter weight means coupled to said axle for rotation about said axle relative to said crank means to aid in counter balancing the weight of the remaining portion of the fluid pumped, and means for rotating said auxiliary counter weight means about said axle relative to said crank means to aid in counter balancing the weight of the remaining portion of the fluid pumped.

2. The well pumping unit of claim 1 wherein said means for rotating said auxiliary counter weight means comprises:

first means coupled to said auxiliary counter weight means, second means secured against movement, endless means for rotating said auxiliary counter weight means upon rotation of said shaft means and hence said crank means.

3. A well pumping unit comprising:

a walking beam pivotally coupled to a Sampson post for pumping operations, sucker rod means coupled to one end of said walking beam, crank means including main counter weight means for counter balancing the weight of said sucker rod means and a portion of the weight of the fluid pumped, power means having shaft means connected to said crank means at a first end for rotating said crank means, pitman means pivotally connected to said crank means and to said walking beam at an end opposite said one end for operating said walking beam upon rotation of said crank means, and auxiliary counter weight means coupled to said crank means for rotation relative to said crank means to aid in counter balancing the weight of the remaining portion of the fluid pumped, said auxiliary counter weight means being coupled to said crank means at a position spaced from the point of connection of said shaft means to said crank means whereby the axis of rotation of said auxiliary counter weight means rotates about the axis of rotation of said crank means as said crank means is rotated by said power means.

4. A well pumping unit comprising:

a walking beam pivotally coupled to a Sampson post for pumping operations, sucker rod means coupled to one end of said walking beam, crank means including main counter weight means for counter balancing the weight of said sucker rod means and a portion of the weight of the fluid pumped, power means having shaft means connected to said crank means at a first end for rotating said crank means, pitman means pivotally connected to said crank means and to said walking beam at an end opposite said one end for operating said walking beam upon rotation of said crank means, and auxiliary counter weight means supported for rotation about a movable axis located between said main counter weight means and the point of connection of said shaft means to said crank means, said auxiliary counter weight means being supported for rotation relative to said crank means to aid in counter balancing the weight of the remaining portion of the fluid pumped, said movable axis of said auxiliary counter weight means being rotatable about the axis of rotation of said crank means as said crank means is rotated by said power means.

5. The well pumping unit of claim 4 comprising:

arm means connected to said shaft means for rotation therewith, and means connected to said arm means at a radial position spaced from said shaft means defining said movable axis of said auxiliary counter weight means.

6. A well pumping unit comprising:

a walking beam pivotally coupled to a Sampson post for pumping operations, sucker rod means coupled to one end of said walking beam, crank means including main counter weight means for counter balancing the weight of said sucker rod means and a portion of the weight of the fluid pumped, power means having shaft means connected to said crank means at a first end for rotating said crank means, pitman means pivotally connected to said crank means and to said walking beam at an end opposite said one end for operating said walking beam upon rotation of said crank means, and auxiliary counter weight means supported for rotation about a movable axis located at a radial position between said main counter weight means and the point of connection of said shaft means to said crank means, means for causing said auxiliary counter weight means to rotate relative to said main counter weight means as said crank means is rotated by said power means to aid in counter balancing the weight of the remaining portion of the fluid pumped, said movable axis of said auxiliary counter weight means being rotatable about the axis of rotation of said crank means as said crank means is rotated by said power means.

7. A well pumping unit comprising:

a walking beam pivotally coupled to a Sampson post for pumping operations, sucker rod means coupled to one end of said walking beam, crank means including main counter weight means for counter balancing the weight of said sucker rod means and a portion of the weight of the fluid pumped, power means having shaft means connected to said crank means at a first end for rotating said crank means, pitman means pivotally connected to said crank means and to said walking beam at an end opposite said one end for operating said walking beam upon rotation of said crank means, auxiliary counter weight means supported for rotation about a movable axis located at a radial position between said main counter weight means and the point of connection of said shaft means to said crank means, and means for maintaining said auxiliary counter weight means extended in a given direction as said crank means is rotated by said power means to aid in counter balancing the weight of the remaining portion of the fluid pumped, said movable axis of said auxiliary counter weight means being rotatable about the axis of rotation of said crank means as said crank means is rotated by said power means.

8. The well pumping unit of claim 7 comprising:

auxiliary counter weight rod means having one end connected to said auxiliary counter weight means and an opposite end supported for rotation about said movable axis, said means for maintaining said auxiliary counter weight means extended in said given direction, maintains said auxiliary counter weight rod means pointing in said given direction as said crank means is rotated by said power means.

9. A well pumping unit comprising:

a walking beam pivotally coupled to a Sampson post for pumping operations, sucker rod means coupled to one end of said walking beam, crank means including main counter weight means for counter balancing the weight of said sucker rod means and a portion of the weight of the fluid pumped, power means having shaft means connected to said crank means at a first end for rotating said crank means, pitman means pivotally connected to said crank means and to said walking beam at an end opposite said one end for operating said walking beam upon rotation of said crank means, arm means fixedly secured to said shaft means and extending radially outward therefrom, an axle fixedly connected to said arm means at a radial position between said main counter weight means and the point of connection of said shaft means to said crank means, said axle rotating with said arm means as said shaft is rotated by said power means, auxiliary counter weight means coupled to said axle for rotation about said axle relative to said crank means to aid in counter balancing the weight of the remaining portion of the fluid pumped, and means for rotating said auxiliary counter weight means about said axle relative to said crank means to aid in counter balancing the weight of the remaining portion of the fluid pumped.

* * * * *